US006801735B2

(12) United States Patent
Komiya et al.

(10) Patent No.: US 6,801,735 B2
(45) Date of Patent: Oct. 5, 2004

(54) IMAGE FORMING APPARATUS WHICH CAN CLEAN AUXILIARY MEMBER ERASING IMAGE TRACES

(75) Inventors: Yoshiyuki Komiya, Shizuoka-ken (JP); Fumiteru Gomi, Shizuoka-ken (JP); Koichi Hashimoto, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/215,016

(22) Filed: Aug. 9, 2002

(65) Prior Publication Data

US 2002/0191985 A1 Dec. 19, 2002

Related U.S. Application Data

(62) Division of application No. 09/667,523, filed on Sep. 22, 2000, now Pat. No. 6,459,872.

(30) Foreign Application Priority Data

Sep. 24, 1999 (JP) ..... 11-270238

(51) Int. Cl.[7] ..... G03G 15/30
(52) U.S. Cl. ..... 399/149; 399/149; 399/354
(58) Field of Search ..... 361/214, 225, 361/230; 399/43, 71, 148, 149, 353, 150, 354

(56) References Cited

U.S. PATENT DOCUMENTS 6,006,055 A 12/1999 Furuya ..... 399/149

FOREIGN PATENT DOCUMENTS

JP 7-72774 A 3/1996

*Primary Examiner*—Hoang Ngo
(74) *Attorney, Agent, or Firm*—Fitzpatrick, Cella, Harper & Scinto

(57) ABSTRACT

When image forming is repeated with cleanerless image forming apparatus "positive ghost" which means that the preceding image is slightly left occurs because residual toner is not recovered by developing means.

Even if an image forming apparatus with an electrically conductive brush or auxiliary means repeats image forming or continuously forms image with a high image ratio, resistance of the brush increases because residual toner is deposited on the electrically conductive brush. In the results, advantages of the electrically conductive brush which erases traces of the preceding image are lost.

Therefore, they are provided, an image forming apparatus which does not let image traces leave and an image forming apparatus which prevents the resistance of auxiliary means and cleans auxiliary means.

7 Claims, 10 Drawing Sheets

DRUM DRIVE
CHARGING APPARATUS (CHARGING DEVICE)
CHARGING BIAS
DEVELOPING APPARATUS (DEVELOPING DEVICE)
DEVELOPING BIAS
TRANSFERRING APPARATUS (TRANSFERRING BELT)
TRANSFERRING BIAS
CONDUCTIVE BRUSH BIAS
ON
OFF
t1
t2
t3
t4
t5
t6
t7
t8
t9
t10
t11
t12
NORMAL IMAGE FORMING OPERATION
CONDUCTIVE BRUSH CLEANING OPERATION (AFTER COMPLETING IMAGE FORMING)

IMAGE FORMING APPARATUS WHICH CAN CLEAN AUXILIARY MEMBER ERASING IMAGE TRACES

CROSS REFERENCE TO RELATED APPLICATION

This application is a division of application Ser. No. 09/667,523, filed Sep. 22, 2000 now U.S. Pat. No. 6,459, 872.

BACKGROUND OF THE INVENTION

1. Field of the Invention

The present invention relates to an image forming apparatus which uses an electrophotography method or an electrostatic method, such as a copying machine or a printer.

2. Related Background Art

In recent years, image forming apparatuses, such as copying machines and printers, of a cleanerless type have been put into practical use. This type of apparatus eliminates or significantly reduces waste toner by recycling residual toner using a developing apparatus after large transfer.

FIG. 1 is a schematic view of an example of a cleanerless image forming apparatus.

A reference numeral 104 denotes a rotating drum type electrophotography photosensitive body (photosensitive drum), serving as an image bearing body. The photosensitive body 101 is turned counterclockwise as indicated by an arrow at a predetermined circumferential speed. A reference numeral 102 indicates a magnetic brush member (magnetic brush charger), serving as a contact charging member, which brush member is disposed, a charging location a being formed with a magnetic brush in contact with the photosensitive drum 101. A charging bias is applied to the magnetic brush member 102 by a bias power supply S1 to uniformly charge the rotating photosensitive drum 101 by contact so that predetermined polarity and a predetermined potential are provided.

The uniformly charged surface of the rotating photosensitive drum 101 is subjected to image exposure L by image exposing means, not shown, as electrostatic latent image forming means, thus reducing the charging potential of the exposed bright part of the photosensitive drum surface, so that an electrostatic latent image corresponding to an image exposing pattern is formed on the photosensitive drum surface.

A reference numeral 103 indicates a developing apparatus, which develops the electrostatic latent image on the surface of the rotating photosensitive drum 1 to form a toner image ta. A reference numeral 103*a* indicates a developing member, such as a developing sleeve roller or a developing roller, to which a predetermined bias is applied. The developing member 103*a* and the photosensitive drum 101 are opposite to each other to provide a developing location b.

A reference numeral 104 indicates a transferring roller (conductive roller) serving as transferring means, which is pressed against the photosensitive drum 101 in a predetermined way to form a transferring location (transferring nip) c. A transferring sheet P is fed to the transferring location c from a sheet feeding mechanism, not shown, at predetermined control times, clamped at the transferring location c, and conveyed. While the transferring sheet P passes the transferring location c, a predetermined transferring bias, which is opposite in polarity to charged toner, is applied to the transferring roller 104 by a bias power supply S3 to electrostatically transfer the toner image ta on the photosensitive drum 101 onto the transferring sheet P. A combination of reference characters, tb, indicates the toner image transferred onto the transferring sheet P.

After it passes the transferring location c, the transferring sheet P is separated from the photosensitive drum 101, conveyed to fixing means, not shown, subjected to toner image fixing therein, and ejected as a print.

As the photosensitive drum 101 rotates, residual toner tc deposited on the drum due to toner image transfer onto the transferring sheet P goes through the charging location a to the developing location b, where the residual toner is cleaned (recovered) from the drum by the developing apparatus 102 simultaneously with developing.

Cleaning residual toner from the drum simultaneously with development is to recover the residual toner tc left on the photosensitive drum 101 due to image transfer, using fog removal bias (DC voltage applied to the developing means and fog removal potential difference V back, or difference between photosensitive drum surface potentials) at the developing apparatus 103 during development in the following steps. The treatment is performed in parallel with image forming steps, such as charging, exposure, development, and transfer, if the image area is longer in the direction of rotation of the photosensitive drum 1 than the circumference of the photosensitive drum 1. This allows the residual toner tc to be recovered at the developing apparatus 103 and used in the following steps, thus eliminating waste toner. In addition, because no cleaning apparatus is necessary, space is significantly saved and the apparatus can markedly be reduced in size.

Contact charging apparatuses, that is, apparatuses which bring a contact charging member to which a voltage is applied into contact with a body to be charged to charge the body, have advantages over corona chargers of non-contact type because of a small amount of ozone produced, low electric power consumption, and so on. Thus charging apparatuses of such a type have been put into practice as charging means for a body to be charged, such as a photosensitive drum, in an image forming apparatus.

A magnetic brush member is preferably used as a contact charging member.

A magnetic brush member is electrically conductive magnetic particles which are magnetically bound on a sleeve, containing a magnet, to provide a magnetic brush. When it is stationary or rotates, the magnetic brush member is brought into contact with a charged body, and a voltage is applied to the member to start charging.

Alternatively, a fur brush member, a brush into which electrically conductive fibers are formed, or an electrically conductive roller (charging roller), a roll into which electrically conductive rubber is formed, is preferably used as a contact charging member.

Using an organic photosensitive body having a surface layer over which electrically conductive particles are spread as an image bearing body or an amorphous silicon photosensitive body in addition to a contact charging member as described above allows a charging potential almost equal to the DC component of a bias applied to the contact charging member to be provided on the surface of the image bearing body. Such a charging method is called "injection charging". Using a small amount of electric power, injection charging can be performed without producing ozone because discharging is not done, using, for example, a corona charger to charge a body to be charged. This charging method has been a focus of attention.

However, when image forming is repeated, using a cleanerless image forming apparatus as described above, the preceding image is slightly left, that is, a "positive ghost" occurs because residual toner is not recovered by developing means. A positive ghost is caused by the part of the photosensitive drum surface which is not charged under the residual toner tc on the photosensitive drum 101 when the toner passes the charging location a. This phenomenon is distinctive if the contact charging member 102 is contaminated.

In charging the part of the photosensitive drum surface under the residual toner tc using the contact charging member 102, it is essential to remove the residual toner tc from the photosensitive drum 101 during charging and return the toner to the photosensitive drum surface after charging to recover it using the developing apparatus 103.

To solve this problem, means for preventing a positive ghost is available which makes it easy to take the residual toner tc in the magnetic brush member 102 by applying a bias opposite in polarity to a charging bias by a bias power supply to an electrically conductive brush 105, auxiliary means for erasing the traces of the preceding image, which is disposed in contact with the photosensitive drum 101 upstream of the transferring location c in the direction of photosensitive drum rotation and downstream of the charging location a in the direction of photosensitive drum rotation.

The residual toner tc, which is conveyed from the transferring location c to a contact d between the surface of the photosensitive drum and the electrically conductive brush 105, often contains both charged toner with normal polarity (normal-polarity toner) and charged toner with reverse polarity (reverse-polarity toner). While it is on the surface of the photosensitive drum 101, reverse-polarity toner passes the contact d between the surface of the photosensitive drum and the electrically conductive brush 105 to the charging location a because the toner is equal in polarity to a bias applied to the electrically conductive brush 105.

On the other hand, normal-polarity toner and discharged toner are electrostatically taken in from the surface of the photosensitive drum 101 by the electrically conductive brush 105 to undergo primary collection. They are discharged and then recharged to reverse their polarity. The resulting toner with reverse polarity is ejected from the electrically conductive brush 105 against the surface of the photosensitive drum 101 and conveyed to the charging location a.

That is, the residual toner tc is given reverse polarity by the electrically conductive brush 105. The residual toner with reverse polarity is removed at the charging location a from the surface of the photosensitive drum 101 and taken in by the magnetic brush of the magnetic brush member 102 to mix the toner (secondary collection of the residual toner by the contact charging member). This causes the part of the surface of the photosensitive drum which is under the residual toner to be charged, thus preventing a positive ghost.

After undergoing secondary collection by the magnetic brush of the magnetic brush member 102, reverse-polarity toner is discharged and then recharged to return its polarity to normal. The resulting normal-polarity toner is electrostatically ejected from the magnetic brush against the surface of the photosensitive drum 101, conveyed to the developing location b, and cleaned simultaneously with development by the developing apparatus 103.

However, if even an image forming apparatus with the above-described electrically conductive brush 105, or auxiliary means for erasing the traces of the preceding image, repeats image forming or continuously forms images with a high image ratio, residual toner is deposited on the electrically conductive brush 105, thus increasing the resistance of the brush 105, so that the original object and advantage of the electrically conductive brush 105, that is, erasing the traces of the preceding image (preventing a positive ghost) by primary collection, discharging, reverse-polarity charging, ejection of normal-polarity toner and discharged toner in the residual toner are not provided.

SUMMARY OF THE INVENTION

It is an object of the present invention to provide an image forming apparatus which does not let image traces leave.

It is another object of the present invention to provide an image forming apparatus which prevents the resistance of auxiliary means.

It is still another object of the present invention to provide an image forming apparatus which can clean auxiliary means.

It is a further object of the present invention to provide an image forming apparatus which includes an image bearing body; charging means for charging the image bearing body; image forming means for forming an electrostatic image on the image bearing body, charged by the charging means; developing means for developing the electrostatic image on the image bearing body, using toner and recovering residual toner from the image bearing body; transferring means for transferring a toner image on the image bearing body onto a transferring sheet; auxiliary means which comes in contact with the image bearing body after transfer, so that a voltage opposite in polarity to a charge given by the charging means is applied to the auxiliary means; and cleaning means for cleaning the auxiliary means by producing such an electric field that toner goes from the auxiliary means to the image bearing body.

Other objects of the present invention will be clear from the following descriptions.

DESCRIPTION OF THE PREFERRED EMBODIMENTS

Figure 1:
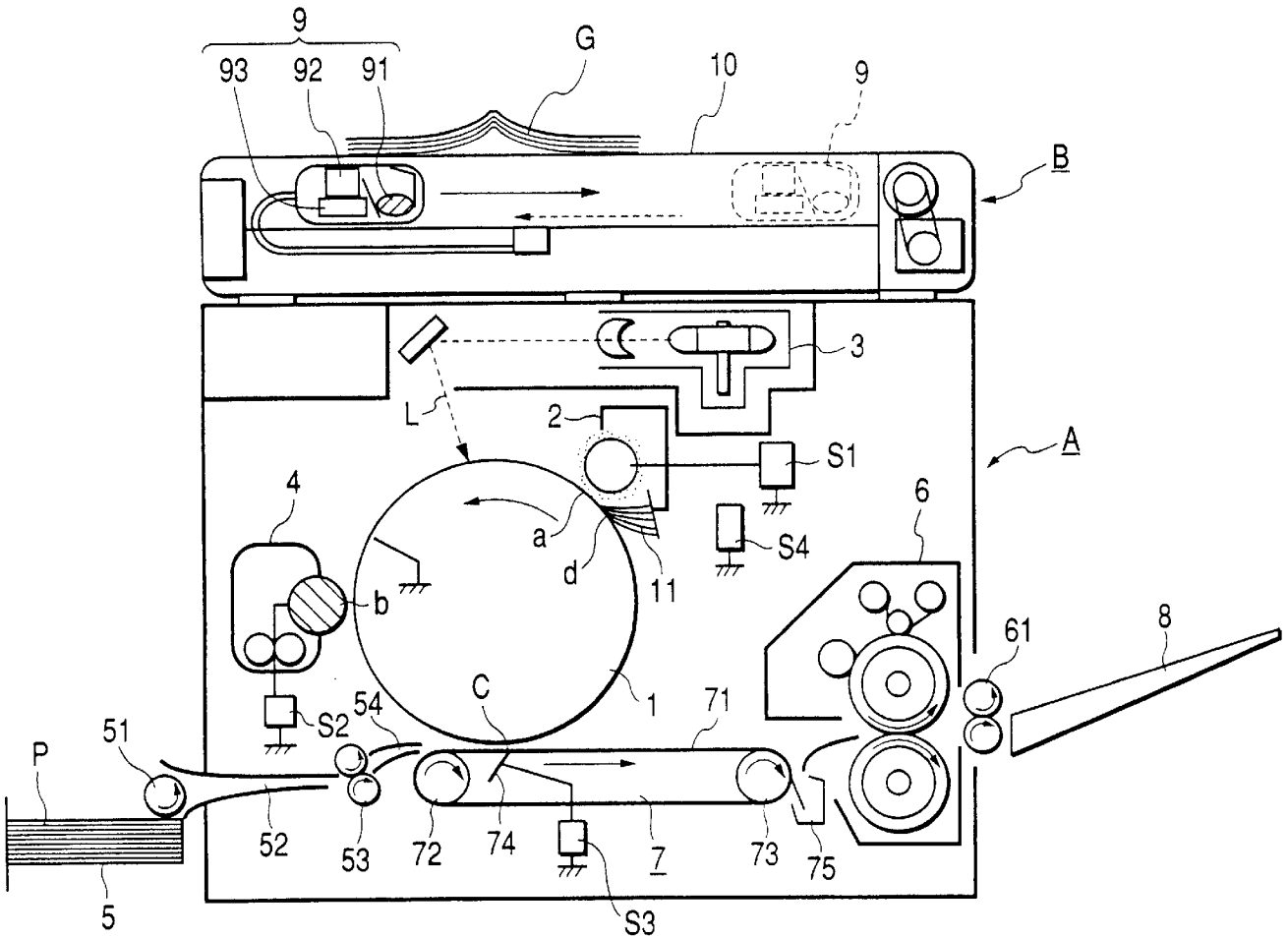
FIG. 1 is a schematic view of an example of an image forming apparatus according to a first embodiment.

Referring now to the drawings, the embodiments of the present invention will be described below.

<First Embodiment>

FIGS. 1 through 7 show the first embodiment.

FIG. 1 is a schematic view of an example of an image forming apparatus according to the present invention. The image forming apparatus is a cleanerless laser beam printer which uses an electrophotography process.

Reference characters A and B denotes a laser beam printer and an image reading apparatus (image scanner) on the printer, respectively.

a) Image Reading Apparatus B

A reference numeral 10 indicates a glass original platform 10, which is arranged on top of the apparatus B. An original G is placed on the glass original platform, with its face to be copied up and covered with an original pressing plate, not shown.

A reference numeral 9 indicates an image reading unit, which is provided with an original lamp 91, short-focus lens array 92, a CCD sensor 93, and so on. By pressing a copy button, not shown, the image reading unit 9 is reciprocated to move from a home position, indicated by a solid line, on the left side of the glass original platform 10 to the right side along the underside of the glass sheet and, after it reaches a predetermined end, return to the home position.

While the unit 9 is reciprocated, the underside of the original G, placed on the glass original platform 10, is lit up and scanned from the left side to the right side, using the original lamp 91, and scanning light reflected from the original enters the CCD sensor 93 through the short-focus lens array 92 and makes an image.

The CCD sensor 93 consists of a light receiving unit, a transferring unit, and an output unit. An optical signal is converted into a charge signal in the light receiving unit. Then the charge signal is synchronized with a clock pulse in the transferring unit and transferred therefrom to the output unit. Finally, the charge signal is converted into a voltage signal, amplified, reduced in impedance in the output unit, and output therefrom. The resulting analog signal is given known image processing to convert it into a digital signal and sent to the printer A.

That is, the image reading apparatus B photoelectrically reads image information on the original G as a time series digital pixel signal (image signal).

b) Printer A

A reference numeral 1 indicates rotating drum type electrophotography photosensitive body (photosensitive drum) in the printer A. The photosensitive drum 1 is a negatively charged OPC photosensitive body which has a charge injection layer on its surface. The photosensitive body will be described in detail in item (2).

The photosensitive body 1 is rotated counterclockwise on a pivot as indicated by an arrow at a predetermined circumferential speed. For the embodiment, when a copy signal is fed, contact charging means 2 uniformly and negatively charges the drum at the charging location a. A magnetic brush charger is used as contact charging means 2 in this example. The contact charging means 2 will be described in detail in item (3).

The uniformly charged surface of the rotating photosensitive drum 1 is subjected to scanning exposure L, using a laser beam modulated according to an image signal, output from a laser scanning unit (laser scanner) 3 and sent from the image reading apparatus B to the printer A, to gradually form on the rotating photosensitive drum 1 an electrostatic latent image corresponding to image information on the original G, photoelectrically read by the image reading apparatus B.

The laser scanning unit 3 consists of a light-emitting signal generator, a solid laser element, a collimator lens system, a rotating polygon mirror, and so on. When the surface of the rotating photosensitive drum is subjected to laser scanning exposure L, using the laser scanning unit 3, the solid laser element is first turned on and off at predetermined times according to an image signal fed, using the light-emitting signal generator. A laser beam emitted from the solid laser element is converted into substantially parallel rays by the collimator lens system, scanned by the rotating polygon mirror, rotating fast, and made to form spot images on the surface of the photosensitive drum 1 by a fθ lens group. By such laser beam scanning, an exposure distribution is formed on the surface of the photosensitive drum 1 for one scan. As the photosensitive drum 1 rotates, the surface of the photosensitive drum is scrolled a predetermined amount at right angles to the scanning direction for each scan, thus providing an exposure distribution on the surface of the rotating photosensitive drum according to an image signal.

For the embodiment, electrostatic images formed on the surface of the rotating photosensitive drum 1 are developed in reverse one after another at the developing location b by a developing apparatus 4. The developing apparatus 4 is of a two-component contact developing type. The developing apparatus 4 will be described in detail in item (4).

Transferring sheets P, or recording media, in a sheet feeding cassette 5 are taken out one after another by a sheet feeding roller 51, fed through a sheet path 52 to the printer A, and conveyed by a resist roller through a sheet path 54 to the transferring location c, which is a transferring nip between the photosensitive drum 1 and a transferring belt type transferring apparatus 7, serving as transferring means, at a predetermined timing.

Toner images on the surface of the rotating photosensitive drum 1 are electrostatically transferred one after another onto a transferring sheet P, conveyed to the transferring location c by a transferring charging blade 74, provided inside a transferring belt 71. The transferring apparatus 7 will be described in detail in item (5).

Transferring sheets P, onto which a toner image has been transferred at the transferring location c, are separated one after another from the surface of the photosensitive drum 1, conveyed to a fixing apparatus 6, using a belt extension of the transferring belt type transferring apparatus 7. The toner image on a transferring sheet is thermally fixed by the fixing apparatus, and then the sheet is ejected as a copy or print through an ejecting roller 61 onto an ejected-sheet tray 8.

A reference numeral 11 denotes an electrically conductive brush, or auxiliary means for erasing the traces of the preceding image. The brush is brought into contact with the photosensitive drum 1 downstream of the transferring location c in the direction of photosensitive drum rotation and upstream of the charging location a in the direction of photosensitive drum rotation. For the embodiment, the brush is supplied with the magnetic brush charging means 2.

The cleanerless system, electrically conductive brush 11, and a cleaning sequence for the brush 11 will be described in detail in item (6).

Figure 2:
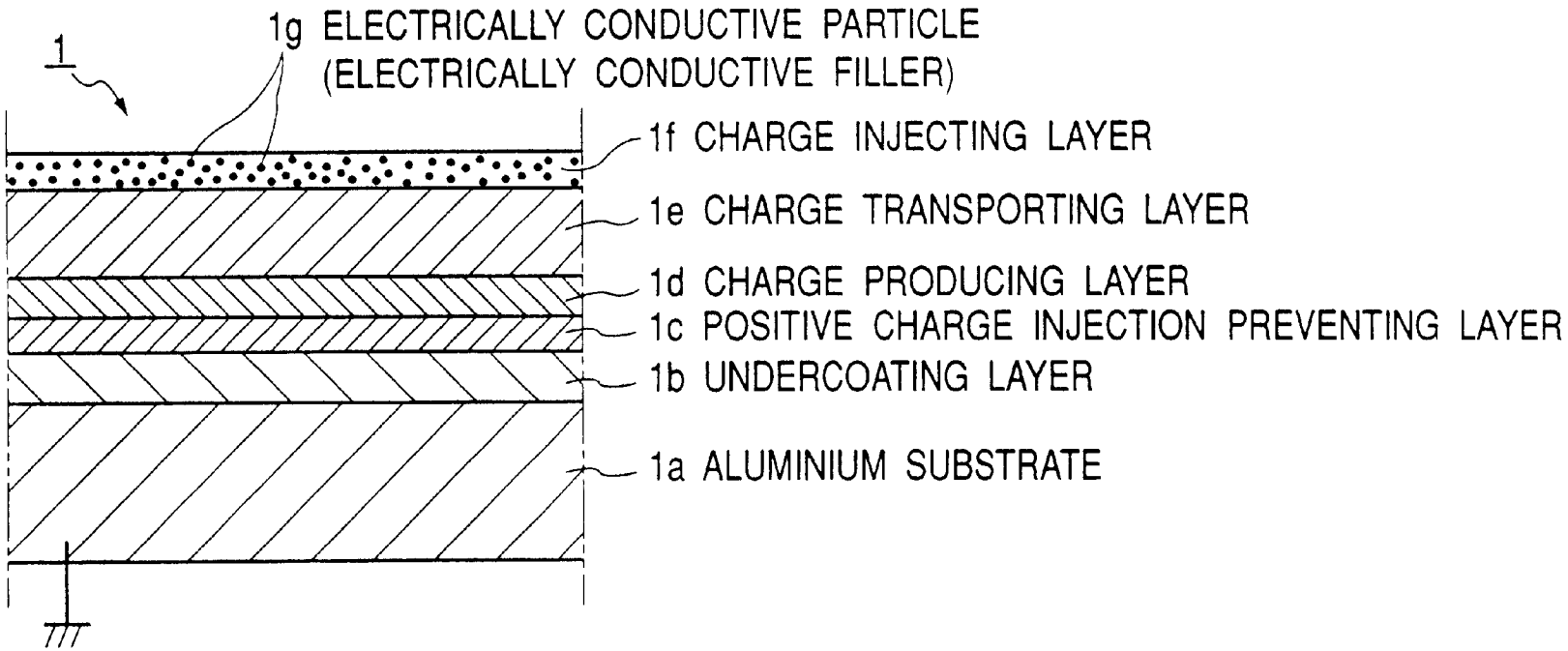
FIG. 2 is a schematic view showing a layer configuration of an image bearing body (photosensitive drum)

(2) Photosensitive Drum 1 (FIG. 2)

An ordinary organic photosensitive body can be used as the photosensitive drum 1, or an image bearing body. A photosensitive body using a semiconductor, containing inorganic substances, such as CdS, Si, and Se, can also be used. An organic photosensitive body which has a layer with a resistance of $10^2$ to $10^{14}$ Ω·cm on its surface or an amorphous silicon photosensitive body can preferably be used. Using such a photosensitive body allows charge injecting charging to be performed, thus preventing ozone from being produced, reducing power consumption, and enhancing charging performance.

For the embodiment, the photosensitive drum 1 used is a negatively charged organic photosensitive body, with a charge injecting layer provided on its surface. The photosensitive body is a 30-mm-in-diameter aluminum drum substrate 1*a* (herein after called the aluminum substrate) on which the following first through fifth layers 1*b* to 1*f* are provided one on top of another in that order. FIG. 2 shows a schematic view illustrating the layer configuration.

The first layer 1*b* is an electrically conductive undercoat 20 μm thick which is provided to remove irregularities and the like on the aluminum substrate 1*a*.

The second layer 1*c* is a charge injection preventing layer which prevents a positive charge injected from the aluminum substrate 1*a* from counteracting a negative charge on the photosensitive body. The layer is a medium-resistance coat 1 μm thick whose resistance is adjusted to about $1\times10^6$ Ω·cm, using Amilan resin and methoxymethylated nylon.

The third layer 1*d* is a charge producing layer about 0.3 μm thick which is produced by dispersing a disazo pigment in a resin. When exposed, the layer produces a pair of positive and negative charges.

The fourth layer le is a charge transporting layer, or a p-type semiconductor, which is produced by dispersing hydrazone in polycarbonate resin. Thus a negative charge on the photosensitive drum cannot move in the fourth layer, yet only a positive charge produced in the charge producing layer 1*d* can be conveyed through the fourth layer to the surface of the photosensitive drum.

The fifth layer 1*f* is a charge injecting layer which is formed by applying an insulating resin binder in which $SnO_2$ ultra-fine particles, or electrically conductive particles 1*g*, are dispersed. Specifically, the layer is formed by applying an insulating resin in which 70 wt % $SnO_2$ particles about 0.03 μm in diameter reduced in resistance (made electrically conductive) by doping antimony, an insulating filler which transmits light are dispersed.

The charge injecting layer is provided by applying a solution, prepared in such a way, to a thickness of about 3 μm by an appropriate method, such as a dipping method, a spray method, a roll method, or a beam method.

The fifth layer has a surface resistance of $10^{13}$ Ω·cm. Controlling surface resistance in such a way allows direct charging performance to be improved, thus forming a high-quality image. The photosensitive body can be made, using not only an OPC but an a-Si drum to provide high durability.

The volume resistance of the surface layer was measured by applying a voltage of 100 V between metal electrodes disposed at 200-μm intervals, with film of the surface layer solution formed between the electrodes. Measurements were made at 23° C. and 50% RH.

Figure 3:
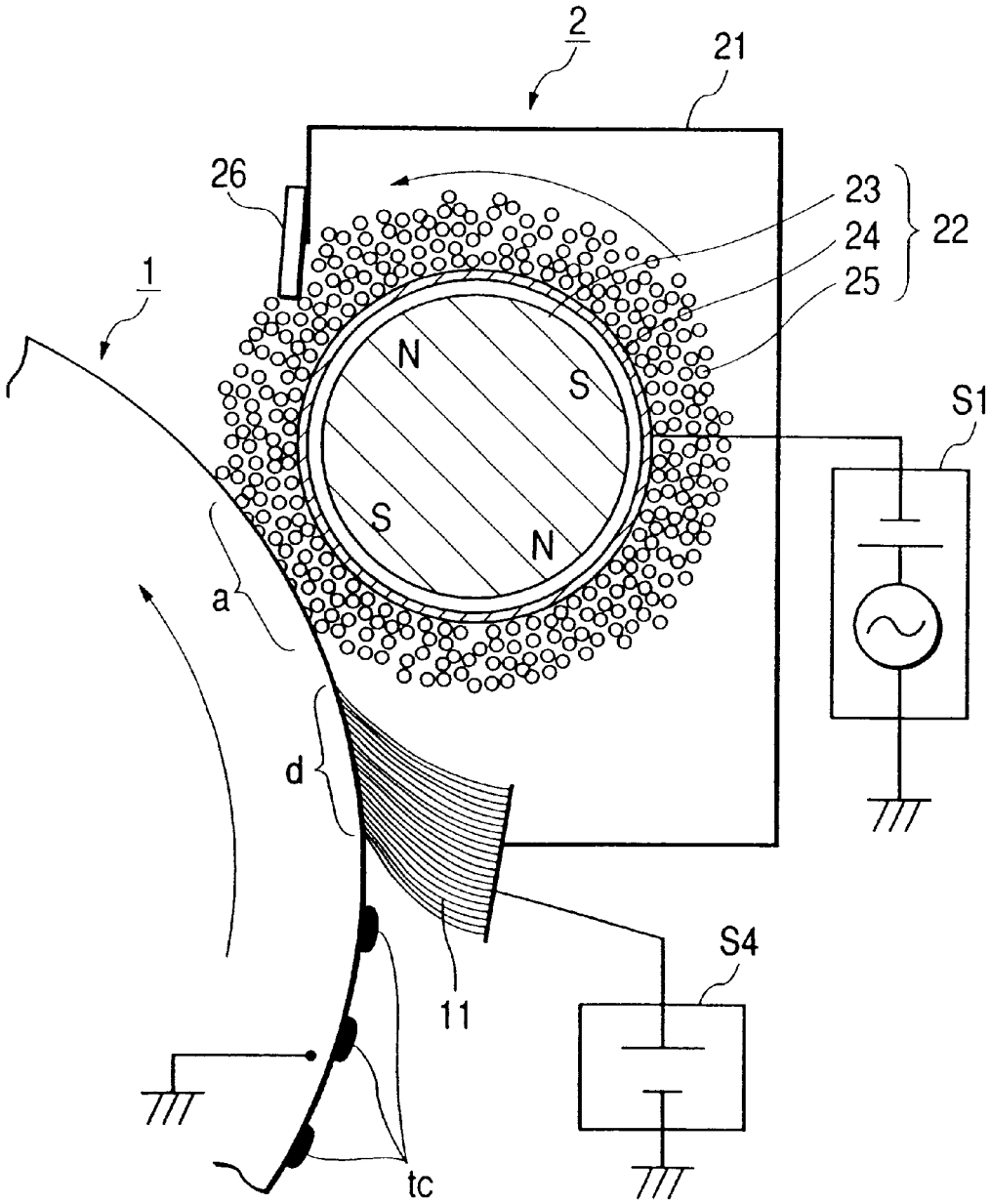
FIG. 3 is a schematic view of a charging apparatus.

(3) Magnetic Brush Charging Apparatus 2 (FIG. 3)

FIG. 3 is a schematic view of a magnetic brush charging apparatus in the embodiment.

A reference numeral 21 indicates charging apparatus housing, and a reference numeral 22 indicates a magnetic brush charging member, or contact charging member, disposed in the housing. The magnetic brush charging member 22 of a sleeve type comprises a magnet roll 23 which is supported not to rotate, non-magnetic sleeve (non-magnetic electrically conductive charging electrode sleeve) 24 which is rotatably placed over the magnet roll 23 to be concentric with the roll, and a magnetic brush 25 which is formed by attracting electrically conductive magnetic particles (charging magnetic carriers) around the outer surface of the nonmagnetic sleeve. A reference numeral 26 denotes a layer thickness limiting blade for the magnetic brush 25, which blade is secured to the housing 21.

The charging apparatus 2 is disposed substantially in parallel with the photosensitive drum 1, with the magnetic brush 25 of the magnetic brush charging member 22 in contact with the surface of the photosensitive drum 1. The width of a contact nip of the magnetic brush 25 (the width of the charging location a) formed with respect to the photosensitive drum 1 is adjusted to a predetermined value.

The magnetic brush 25 is preferably made of charging magnetic particles 10 to 100 μm in average diameter with a saturated magnetization of 20 to 250 emu/cm$^3$ and a resistance of $1\times10^2$ to $1\times10^{10}$ Ω·cm. Considering insulation defects in the photosensitive drum 1, such as pinholes, it is preferred that charging magnetic particles with a resistance of $1\times10^6$ Ω·cm or more be used. To enhance charging performance, charging magnetic particles with as low a resistance as possible should be used. Thus the embodiment uses magnetic particles 25 μm in average diameter with a saturated magnetization of 200 emu/cm$^3$ and a resistance of $5\times10^6$ Ω·cm.

Resin carriers formed by dispersing magnetite, a magnetic material, in a resin and further dispersing carbon black to make the carriers electrically conductive or adjust their resistance or magnetite, such as ferrite, whose resistance is adjusted by oxidizing and reducing its surface or coating the surface with a resin is used as magnetic particles. The embodiment uses ferrite whose surface is oxidized and reduced to adjust its resistance.

The non-magnetic sleeve 24 of the magnetic brush charging member 22 is rotated at the charging location a in the direction opposite to the direction of rotation of the photosensitive drum 1, that is, counterclockwise as indicated by an arrow. As the nonmagnetic sleeve 24 rotates, the magnetic brush 25, made of magnetic particles, is circularly conveyed in the same direction and subjected to layer thickness limitation at the layer thickness limiting blade 26.

A predetermined charging bias is applied to the non-magnetic sleeve 24 from the bias power supply S1. For the embodiment, a vibrating voltage obtained by superposing a negative DC voltage and an AC voltage is applied as a charging bias.

Because for the embodiment, the charge injecting layer if is provided on the surface of the photosensitive drum 1 as described above, the photosensitive drum 1 is charged by charge injection. That is, a charging potential almost equal to the direct-current component DC of the bias, consisting of the AC and DC components, can be provided on the surface of the photosensitive drum 1.

Figure 4:
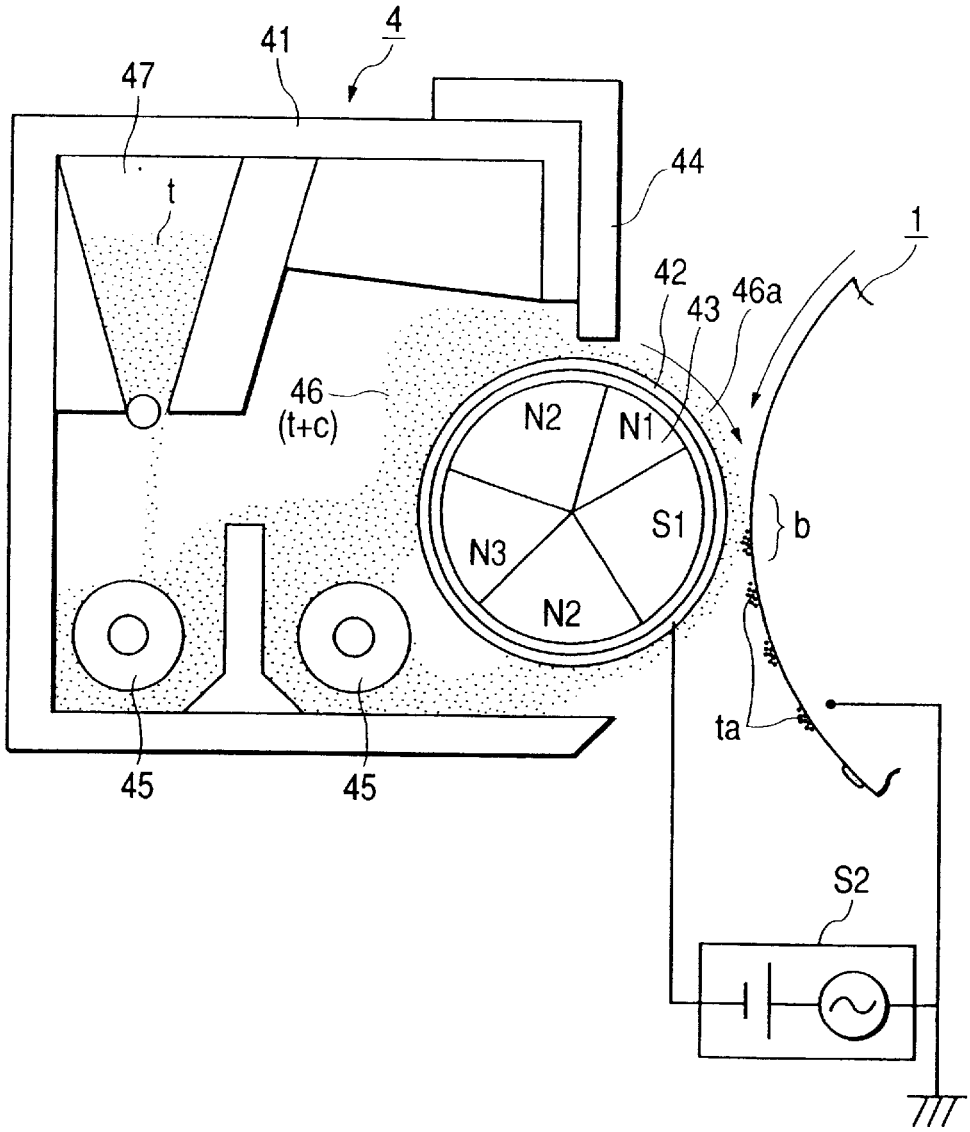
FIG. 4 is a schematic view of a developing apparatus.

(4) Developing Apparatus 4 (FIG. 4)

Methods for developing an electrostatic image are classified into the following types a through d:

a. Non-magnetic toner is applied to the sleeve, using a blade or the like, and magnetic toner is applied under the action of magnetism and conveyed so that it does not come in contact with a photosensitive body (one-component non-contact development).
b. Toner applied in the above-described way is made to come in contact with a photosensitive body (one-component contact development).
c. A mixture of toner particles and magnetic carriers, used as a developer, is conveyed under the action of magnetism, so that the mixture is developed come in contact with a photosensitive body (two-component contact development).
d. A two-component developer as described above is made not to come in contact with a photosensitive body (two-component non-contact development).

Methods of type c are frequently used because they improve image quality and are highly stable.

FIG. 4 is a schematic view of the developing apparatus 4 used for the embodiment. The developing apparatus 4, which uses a mixture of non-magnetic negative toner particles and magnetic carrier particles as a developer, is of a two-component magnetic brush contact development type which conveys the developer, borne as a magnetic brush layer under the action of magnetism by a developer bearing body, to the developing unit and brings it into contact with the photosensitive drum 1 to develop an electrostatic image as a toner image.

A reference numeral 41 indicates a developer container; a reference numeral 42, a developing sleeve serving as a developer bearing body; a reference numeral 43, a magnet roller, or magnetic field producing means secured in the developing sleeve 42; a reference numeral 44, a developer layer thickness limiting blade for forming developer film on the developing sleeve; a reference numeral 45, a developer agitating and conveying screw; and a reference numeral 46, a two-component developer, or a mixture of nonmagnetic negative toner particles t and magnetic carrier particles c, in the developer container 41.

The negatively charged toner particles t in the two-component developer used for the embodiment are 6 $\mu$m in average diameter and mixed with 1 wt % oxidized titanium particles 20 nm in average diameter, and the developing magnetic carrier particles c has a saturated magnetization of 205 emu/cm$^3$ and are 35 $\mu$m in average diameter. The toner particles t and developing carrier particles are mixed together at a weight ratio of 6:94 to prepare the developer 46. The toner particles in the developer have a friction charge of about $25\times10^{-3}$ c/kg.

The developing sleeve 42 is disposed so that it is at a distance of about 500 $\mu$m from the photosensitive drum 1 when the sleeve is closest to the drum at least during development. The sleeve is adapted so that developer magnetic brush film 46*a* on the outer surface of the developing sleeve 42 comes in contact with the photosensitive drum 1.

The developing sleeve 42 is driven clockwise indicated by an arrow around the secured magnet roller 43 at a predetermined rpm. In the developer container 41, a magnetic brush is formed from the developer 46 on the outer surface of the sleeve under the action of magnetism produced by the magnet roller 43. The developer magnetic brush is conveyed as the sleeve 42 rotates, taken out of the developer container as the developer magnetic brush film 46*a* with a predetermined thickness under layer thickness limitation by the blade 44, conveyed to the developing location b, thereby coming in contact with the surface of the photosensitive drum 1, and returned to the developer container 41 as the sleeve 42 continues to rotate.

That is, as the developing sleeve 42 rotates, the developer 46 is taken up by an N3 pole of the magnet roller 43 and conveyed from an S2 pole to an N1 pole. Through this process, the developer is limited by the limiting blade 44, positioned at right angles to the developing sleeve 42 to form the film 46*a* of the developer 46 on the developing sleeve 42. When the film 46*a*, into which the developer is formed, is conveyed to a developing main pole S1 in the developing unit, magnetism forms film ears. The developer film 46*a*, shaped like ears, develops an electrostatic latent image on the photosensitive drum 1 as the toner image ta, and then developer on the developing sleeve 42 is returned to the developer tank 41 under the action of a repulsive magnetic field between N2 and N3 poles.

For the embodiment, a vibrating voltage obtained by superposing a negative DC voltage of −480V and an alternating voltage with an amplitude Vpp of 1500 V and a frequency Vf of 3000 Hz is applied between the developing sleeve 42 and the electrically conductive drum substrate of the photosensitive drum 1 by developing bias power supply S2, as a developing bias.

Generally, for a two-component developing method, applying an alternating voltage increases developing efficiency, thus providing higher-quality image. On the contrary, fog is liable to occur easily. Thus a difference is usually made between a DC voltage applied to the developing apparatus 4 and the potential on the surface of the photosensitive drum 1 to prevent fog. The difference for preventing fog, called a fog preventing potential (Vback), is used to prevent toner from being deposited on a non-image area on the photosensitive drum 1 during development.

The toner concentration in the developer 46 in the developer tank 41 (mixing ratio of toner to a carrier) gradually decreases as toner is consumed to develop an electrostatic latent image. The toner concentration in the developer 46 in the developer tank 41 is detected by detecting means, not shown. When the concentration has fallen below a predetermined allowable lower limit, the developer 46 in the developer tank is replenished with toner by a toner replenishing unit 47 to control the toner concentration to within an allowable range.

(5) Transferring Apparatus 7 (FIG. 1)

For the embodiment, the transferring apparatus 7 is of a transferring belt type as described above. A reference numeral 71 indicates an endless transferring belt, which is tensioned between a driving roller 73 and a driven roller 72. The belt turns around in the direction of forward rotation of the photosensitive drum 1 at almost the same circumferential speed as the photosensitive drum 1. A reference numeral 74 indicates a transferring charging blade disposed inside the transferring belt 71. The blade presses the upper part of the transferring belt 71 against the photosensitive drum 1 to form the transferring location (transferring nip) c. Because a transferring bias is applied from the transferring bias power supply S3, the blade also charges the transferring sheet P from its back so that it is opposite in polarity to charged toner. Thus toner images on the photosensitive drum 1 are transferred one after another onto the transferring sheet P, passing the transferring location c.

The belt 71 used for the embodiment is made of polyimide resin film 75 $\mu$m thick. The material for the belt 71 not limited to polyimide resin, but plastics, such as polycarbonate resin, polyethylene terephthalate resin, polyvinylidene fluoride resin, polyethylene naphthalate resin, polyether ether ketone resin, polyether sulfon resin, and polyurethane resin, and fluorine- and silicone-based rubber can be used. Thickness is not limited to 75 $\mu$m, but film 25 to 2000 $\mu$m, preferably 50 to 150 $\mu$m thick may be used.

The transferring charging blade 74 used has a resistance of $1\times10^5$ to $1\times10^7$ Ω. A bias of +15 $\mu$A is applied to the blade 74 under constant-current control to transfer an image.

(6) Cleanerless System, Electrically Conductive Brush 11, and its Cleaning Sequence After a toner image is transferred, the residual toner tc is left on the photosensitive drum 1. As described above, the cleaner system recovers the residual toner tc by cleaning at the developing location b simultaneously with development by the developing apparatus 4. Letting the residual toner tc pass the charging location a causes charging potential only in an area where part of an image remains after transfer to decrease or a ghost, that is, part of the preceding image densely or thinly appearing on the next image, to occur. If the residual toner tc passes under the magnetic brush 25 of the magnetic brush member 22, which is in contact with the photosensitive drum 1 at the charging location a, the preceding image remains in most cases.

Thus it is necessary to erase the traces of the preceding image by taking the residual toner tc, which reaches the charging location a as the photosensitive drum 1 rotates, in the magnetic brush 25. Only applying a DC voltage to the magnetic brush member 22 does not cause the residual toner to be sufficiently taken in the magnetic brush 25. However, applying an alternating voltage to the magnetic brush member 22 causes the toner to be easily taken in the magnetic brush 25 under the effect of vibration due to an electric field between the photosensitive drum 1 and magnetic brush member 22.

As described above, the residual toner tc often contains both charged toner with normal polarity (normal-polarity toner) and charged toner with reverse polarity (reverse-polarity toner) because of separation charging or the like during image transfer. Considering the ease with which the residual toner is taken in the magnetic brush 25, it is desired that the residual toner tc be charged so that its polarity is opposite to normal polarity. That is, the residual toner tc is desirably charged so that it has positive polarity, or reverse polarity, opposite to negative polarity, or normal polarity.

As described above, for the embodiment, the electrically conductive brush 11, or auxiliary means for erasing the traces of the preceding image, is brought into contact with the photosensitive drum 1 downstream of the transferring location c in the direction of photosensitive drum rotation and upstream of the charging location a in the direction of photosensitive drum rotation. The brush is also supplied with the magnetic brush charging apparatus 2. A positive bias which is opposite in polarity to a charging bias is applied to the electrically conductive brush 11 from a bias power supply S4. Applying a positive bias to the electrically conductive brush 11 causes toner with positive polarity (reverse-polarity toner) in the residual toner tc to pass the contact location d between the electrically conductive brush 11 and photosensitive drum 1 and toner with negative polarity (normal-polarity toner) and discharged toner to be electrostatically collected by the electrically conductive brush 11 (primary collection), discharged, charged to reverse their polarity, and electrostatically ejected against the photosensitive drum 1.

This process causes the residual toner tc to be substantially all opposite in polarity, so that the residual toner is easy to take in the magnetic brush 25 of the magnetic brush member 22. That is, the electrically conductive brush 11 gives reverse polarity to all residual toner tc, and the residual toner is removed at the charging location a from the surface of the photosensitive drum 1 and taken in the magnetic brush 25 of the magnetic brush member 22 to mix the toner (secondary collection of the residual toner by the magnetic brush member 22). This charges part of the photosensitive drum surface under the residual toner, thus preventing a positive ghost.

After undergoing secondary collection by the magnetic brush 25, reverse-polarity toner is discharged and then recharged to return its polarity to normal. By applying a negative-polarity charging bias to the magnetic brush member 22, the resulting normal-polarity toner is electrostatically ejected from the magnetic brush 25 against the surface of the photosensitive drum 1, conveyed to the developing location b, and cleaned simultaneously with development by the developing apparatus 4.

However, as described above, if image forming continues or an image with a high density is formed, much residual toner is deposited on the electrically conductive brush 11. Toner deposits on the electrically conductive brush 11 increase the resistance of the brush, so that the original objects of the electrically conductive brush 11 which are intended for ghost prevention, that is, primary collection, discharging, reverse-polarity charging, ejection of normal-polarity toner in the residual toner are not provided.

For the embodiment, to solve this problem, an image forming apparatus control circuit, not shown, is made to periodically and automatically perform a cleaning sequence for the electrically conductive brush 11 (in a cleaning mode) before or after image formation if the number of images formed by the image forming apparatus reaches a predetermined sum of image density values.

That is, the embodiment has means for calculating the consumption of toner per image from image density information given by an image information signal. A time at which an auxiliary means cleaning sequence is performed is determined from the results of calculation by the means. Specifically, in the embodiment, the image forming apparatus is provided with a video counter, which accumulates the output level of image signals, which are made digital by an analog-digital converter, for each pixel. The accumulation can be converted to a video count, using the video counter. If the sum of image density values reaches a predetermined value, output from the video counter is used to periodically and automatically perform the cleaning sequence for the electrically conductive brush.

Figure 5:
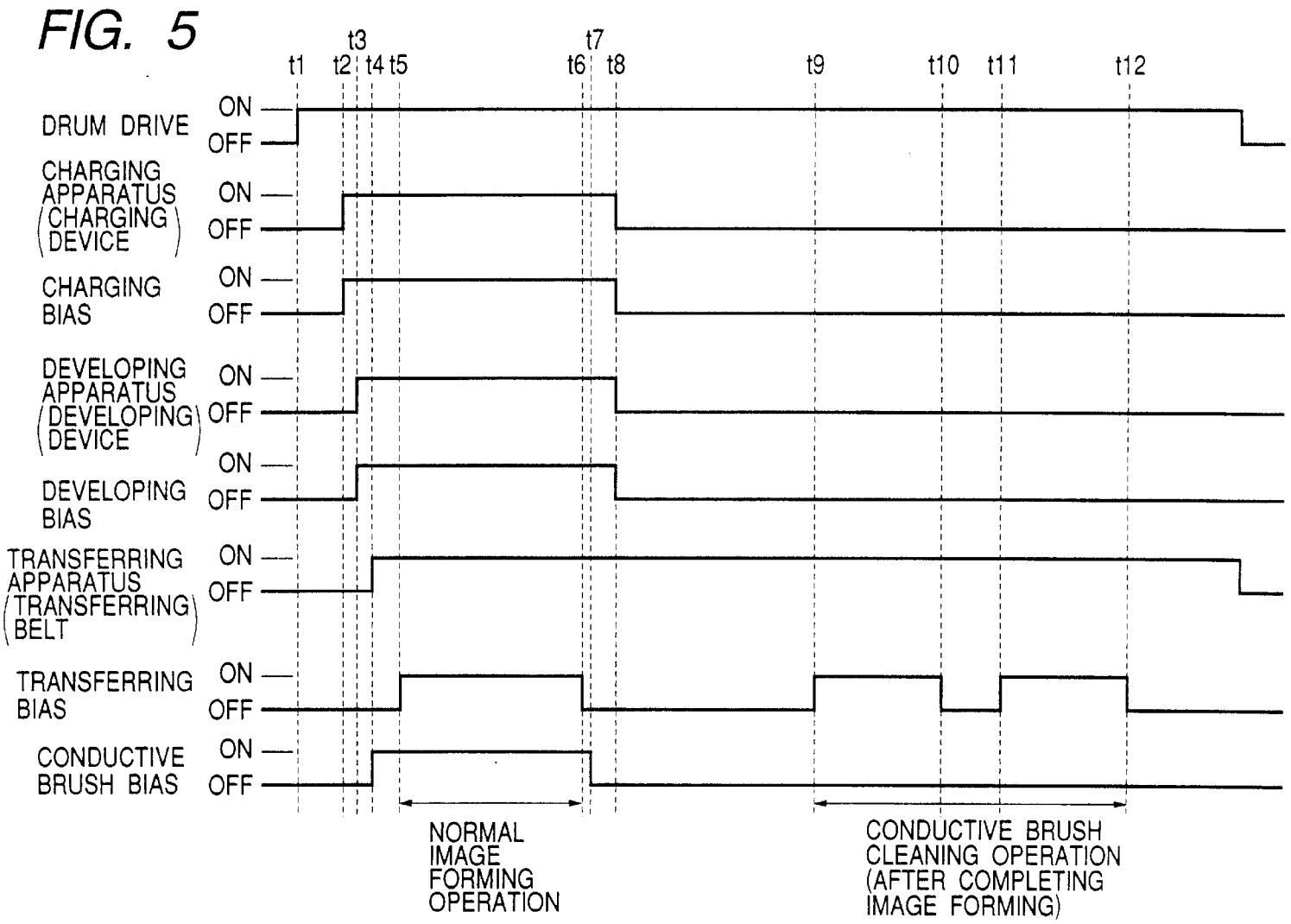
FIG. 5 is a timing chart for an electrically conductive brush cleaning sequence.

Referring now to FIG. 5, cleaning of the electrically conductive brush 11 after image formation will be described. In FIG. 5, the horizontal axis represents time.

1) At a time t1, the photosensitive drum 1 starts to be driven.

2) At a time t2, the charging apparatus starts to be driven, and a bias is applied.

3) At a time t3, the developing apparatus 4 starts to be driven, and a bias is applied.

4) At a time t4, the transferring apparatus 7 starts to be driven, and the electrically conductive brush 11 applies a bias.

5) At a time t5, a transferring bias is applied.

In these steps, an ordinary image is formed.

6) When normal image formation ends, the transferring bias is shut off at a time t6.

7) The electrically conductive brush 11 applies a bias until the area on the photosensitive drum 1 where the transferring bias is on has gone through the electrically conductive brush 11, and then removes the bias at a time t7.

8) At a time t8, the charging apparatus 2 and developing apparatus 4 are stopped, and the bias is shut off. This ends normal image formation.

For the embodiment, the photosensitive drum 1 and transferring apparatus 7 continue to be driven after normal image formation, and the electrically conductive brush 11 is cleaned as described below.

9) After normal image formation, a transferring bias is applied at a time t9. In this case, the charging apparatus 2, developing apparatus 4, and electrically conductive brush 11 are driven, yet no bias is applied.

10) From the time t9 to a time t10, a transferring bias is applied to the transferring charging blade 74 of the transferring apparatus 7 from the power supply S3 to positively charge the photosensitive drum 1. When a positively charged area on the photosensitive drum 1 passes the contact location d with the electrically conductive brush 11, toner deposits on the electrically conductive brush 11 transfer onto the photosensitive drum 1 (development) because no bias is applied to the electrically conductive brush 11. That is, the electrically conductive brush 11 is cleaned.

11) When toner passes the charging apparatus 2 (the charging location a) and the developing apparatus 4 (the developing location b) and reaches the transferring location c after transferring from the electrically conductive brush 11 to the photosensitive drum 1, a transferring bias is applied to the transferring charging blade 74 of the transferring apparatus 7 at a time t11 as in the case of normal image formation, and toner transfers from the photosensitive drum 1 onto the transferring belt 71.

12) Toner on the transferring belt 71 is recovered by a transferring belt cleaner 75.

Figure 6:
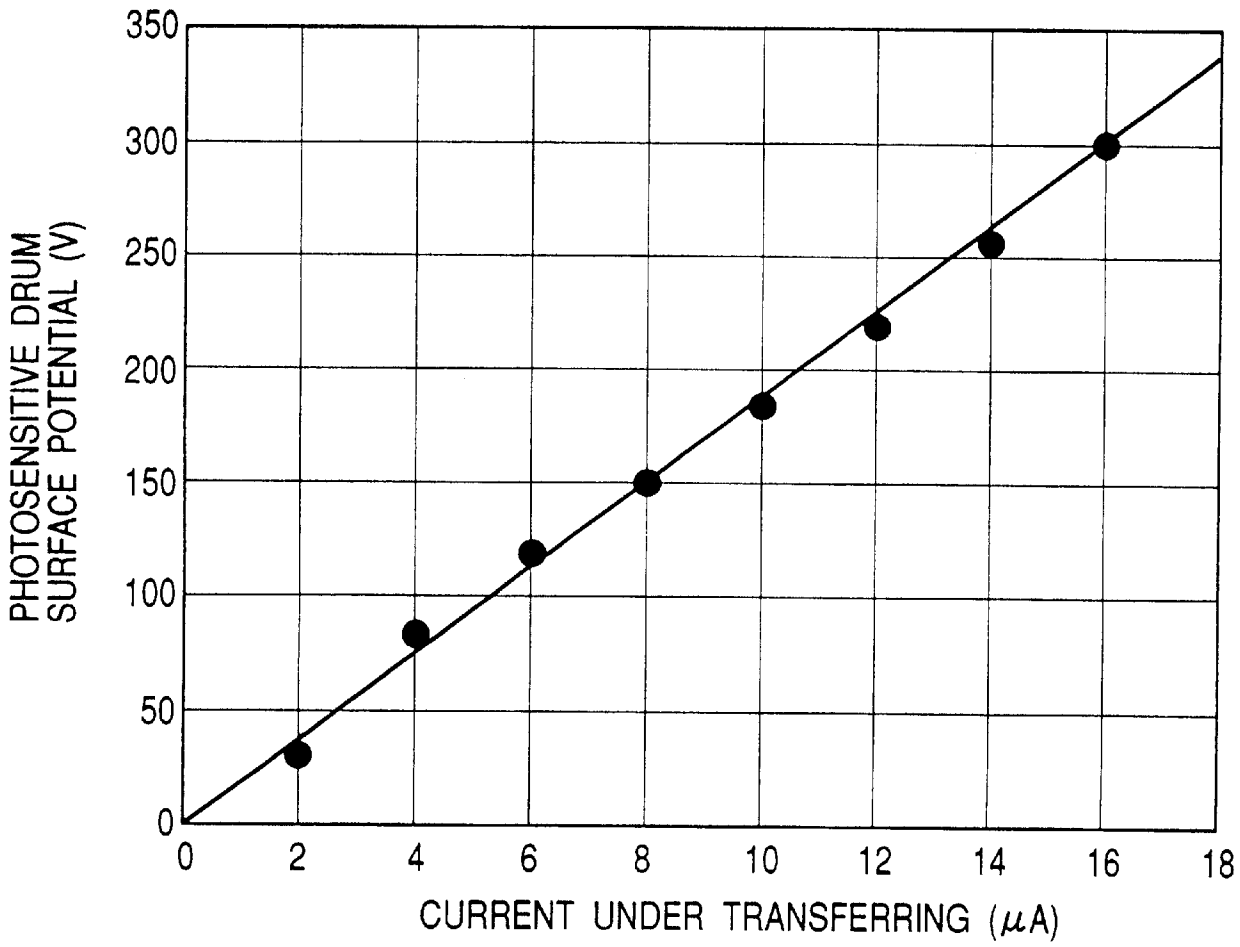
FIG. 6 is a graph showing the relationship between transferring current and photosensitive drum surface potential.

Experiments conducted by the inventor show that the current running through the transferring apparatus 7 is related with the potential on the photosensitive drum 1 as shown in FIG. 6. For the above-described cleaning sequence for the electrically conductive brush 11, it is desirable that the photosensitive drum 1 be positively charged until a voltage of at least about 100 V or, if possible, 200 to 250 V is reached to transfer toner deposits from the electrically conductive brush 11 onto the photosensitive drum 1. The results in FIG. 6 show that the current running through the transferring apparatus 7 is desirably 10 to 14 $\mu$A for the cleaning sequence for the electrically conductive brush 11, while the current is about 10 $\mu$A during normal image formation.

Figure 7:
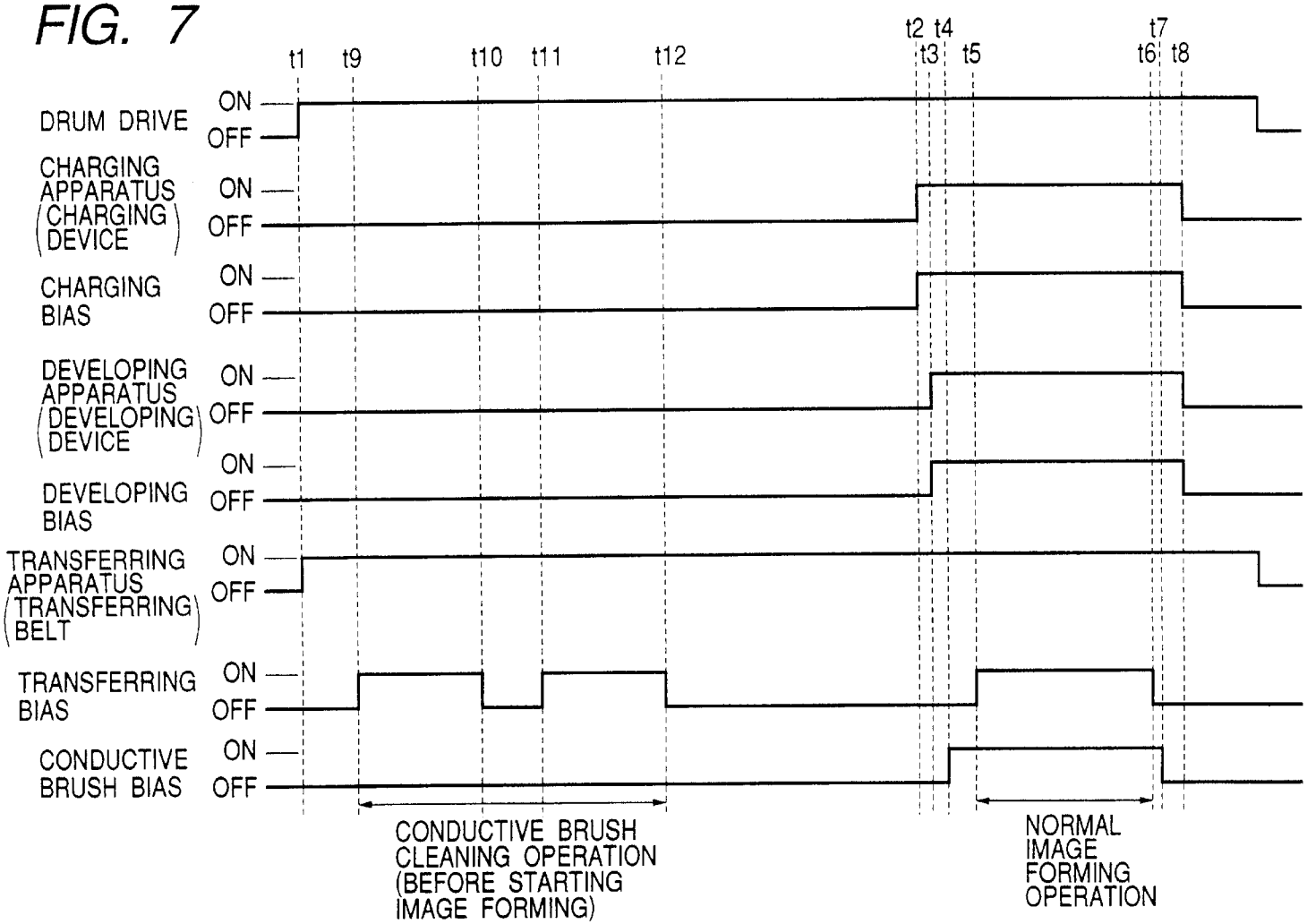
FIG. 7 is another timing chart for the electrically conductive brush cleaning sequence.

FIG. 7 is an example of a timing chart for a cleaning sequence for the electrically conductive brush 11, which sequence is performed before normal image formation. In this case also, when the sum of values of output from a video counter exceeds a predetermined number of images to be formed, the cleaning sequence for the electrically conductive brush 11 is performed before the next image formation starts.

For the embodiment, a positive ghost can be prevented from occurring due to contamination and deterioration of the electrically conductive brush 11 caused by toner, and stable image formation can be maintained for a prolonged period of time by periodically performing the cleaning sequences for the electrically conductive brush 11 in FIGS. 5 and 7 every time a predetermined number of images to be formed is reached.

Figure 8:
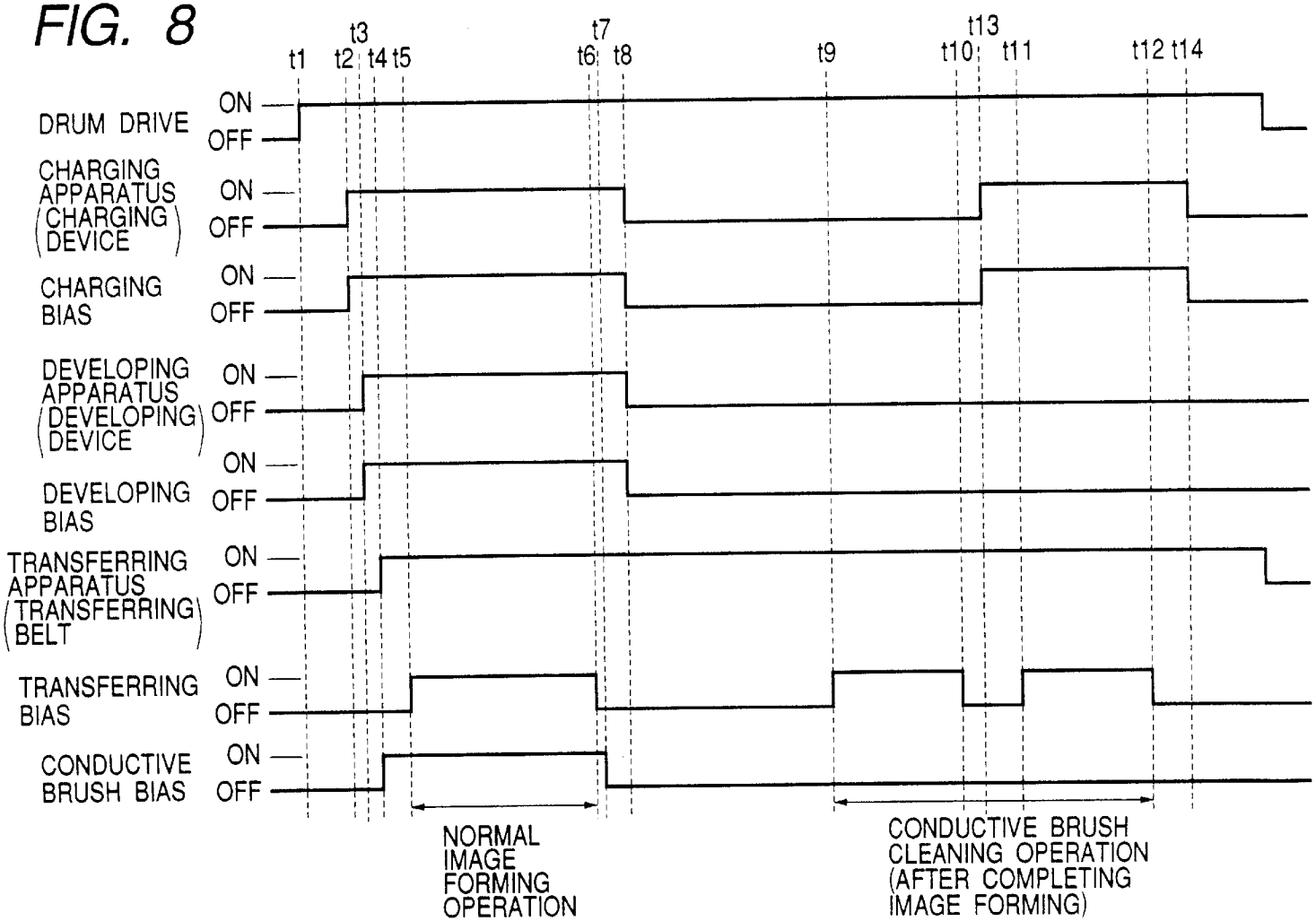
FIG. 8 is a timing chart for an electrically conductive brush cleaning sequence in a second embodiment.
Figure 9:
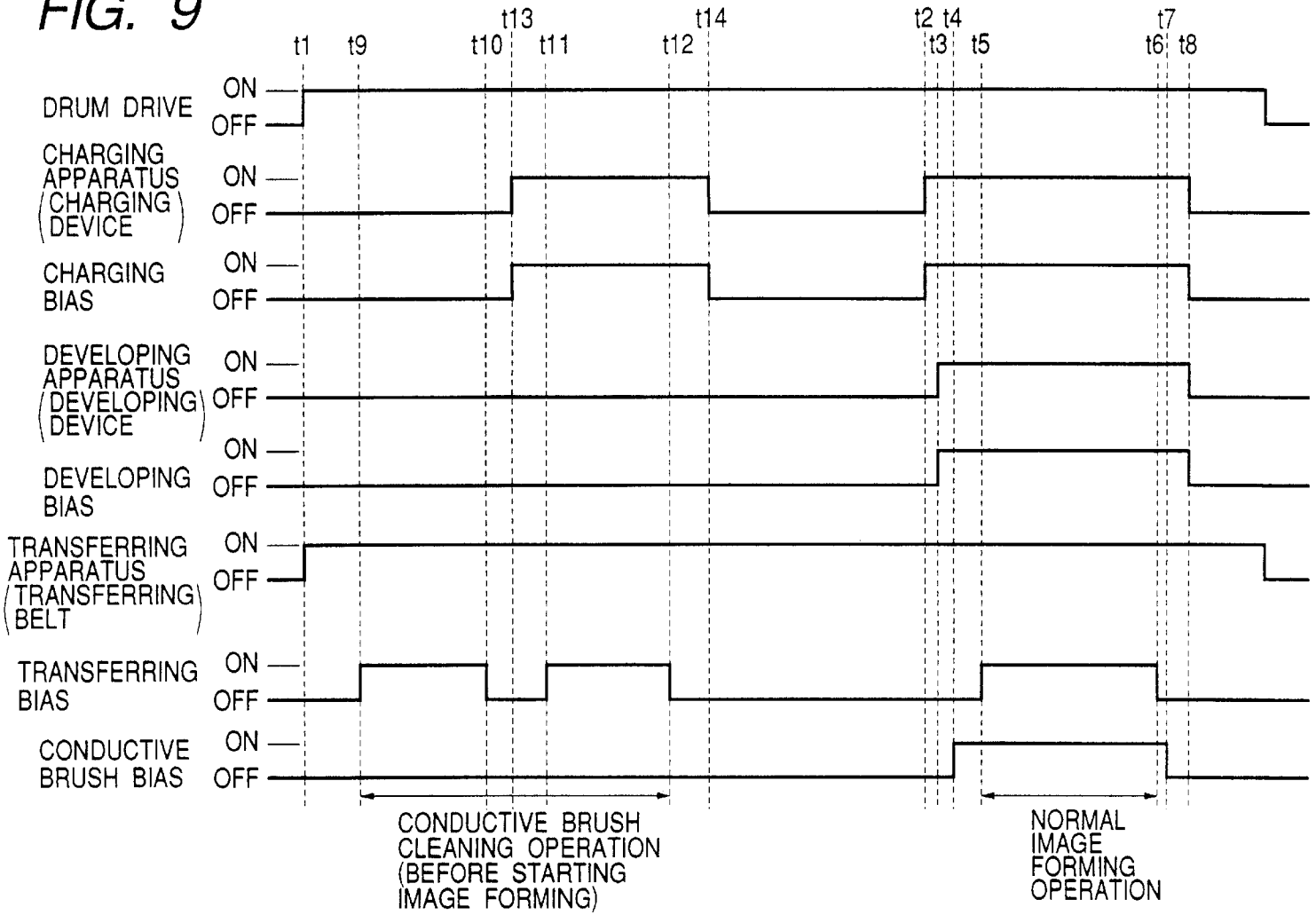
FIG. 9 is another timing chart for the electrically conductive brush cleaning sequence in a second embodiment.
Figure 10:
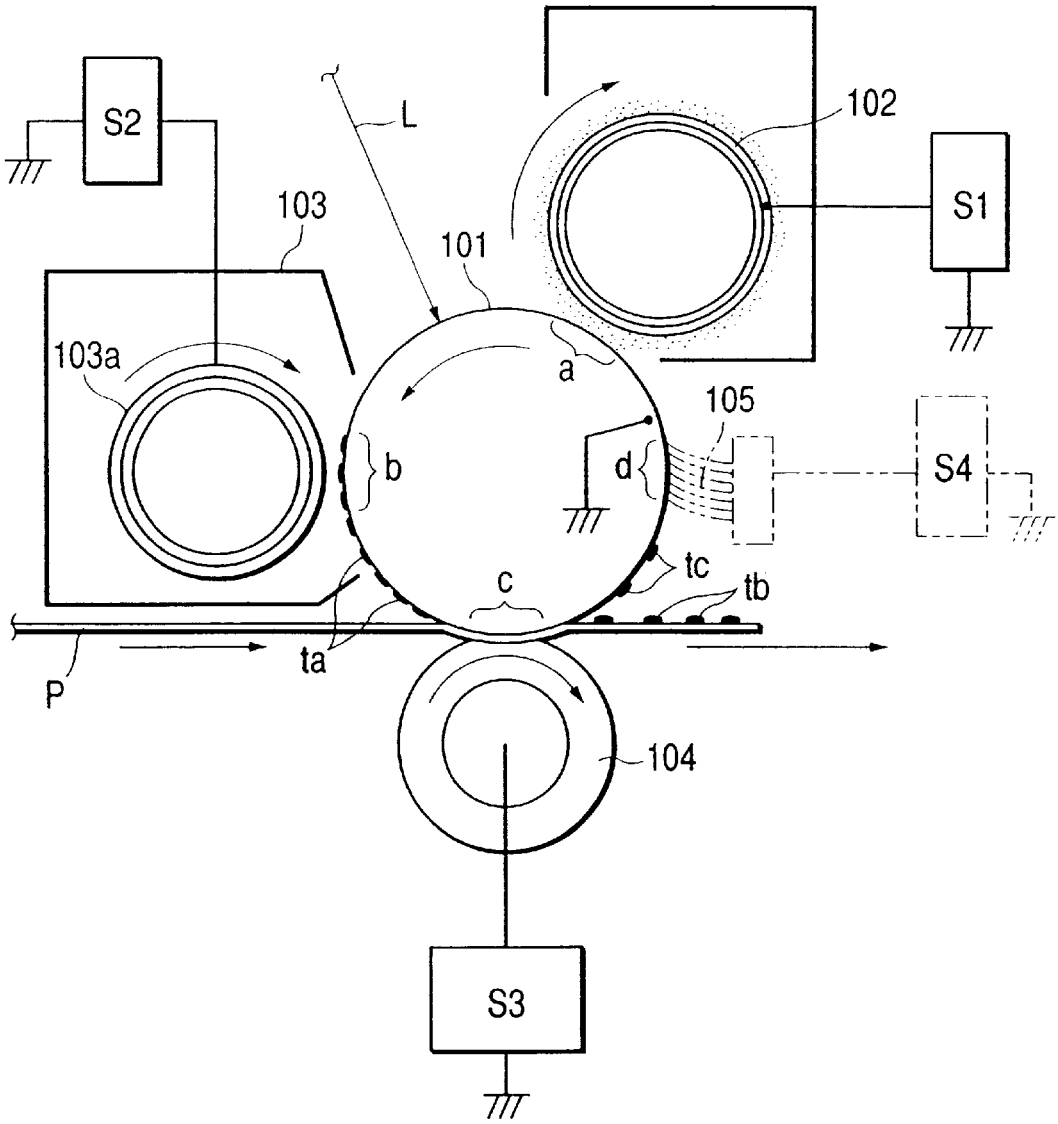
FIG. 10 is a schematic view of an example of a cleanerless image forming apparatus.

<Second Embodiment>(FIGS. 8 and 9)

The second embodiment is another timing chart for a cleaning sequence for the electrically conductive brush.

FIG. 8 is a timing chart for a cleaning sequence for the electrically conductive brush 11 to be performed after image formation. The chart goes like the timing chart of the first embodiment in FIG. 5 until normal image formation is completed, that is, the time t8 is reached.

A transferring bias is applied at the time t9 after normal image formation. When the bias is applied, the charging apparatus 2, developing apparatus 4, and electrically conductive brush 11 are driven, yet no bias is applied.

From the time t9 to a time t10, a transferring bias is applied to the transferring charging blade 74 of the transferring apparatus 7 from the power supply S3 to positively charge the photosensitive drum 1. When a positively charged area on the photosensitive drum 1 passes the electrically conductive brush 11, toner deposits on the electrically conductive brush 11 transfer onto the photosensitive drum 1 because no bias is applied to the electrically conductive brush 11. When toner passes the charging apparatus 2 (the charging location a) and the developing apparatus 4 (the developing location b) and reaches the transferring location c after transferring from the electrically conductive brush 11 to the photosensitive drum 1, a transferring bias is applied to the transferring charging blade 74 of the transferring apparatus 7 at a time t11 as in the case of normal image formation, and toner transfers from the photosensitive drum 1 onto the transferring belt 71. Toner on the transferring belt 71 is recovered by the transferring belt cleaner 75.

For the embodiment, after toner deposits transfer from the electrically conductive brush 11 to the photosensitive drum 1, and the drum makes one turn, the charging apparatus 2 is driven at a time t13, and a bias is applied to remove positive charge memory left on the photosensitive drum 1 positively charged by the transferring apparatus 7. In this case, no special problem arises if the bias applied to the charging apparatus 2 is 0 V or less. Indeed, only an AC voltage may be applied.

Such is also the case with cleaning the electrically conductive brush 11 before image formation starts as shown in FIG. 9.

The above-described arrangement allows a defective image which is likely to occur due to positive-charge memory on the photosensitive drum 1, positively charged by the transferring apparatus 7 when a cleaning sequence for the electrically conductive brush 11 is performed. The arrangement also allows a positive ghost to be prevented from occurring due to contamination or deterioration of the electrically conductive brush 11 and a stable image to be maintained for a prolonged period of time.

<Others>

1) For the first and second embodiments, an image forming apparatus control circuit, not shown, is made to periodically and automatically perform a cleaning sequence for the electrically conductive brush 11 before or after image formation if the number of images formed by the image forming apparatus reaches a predetermined value. However, the present invention can be adapted so that a cleaning sequence for the electrically conductive brush 11 is performed as necessary according to a manual direction.

2) Means for recovering toner which is transferred from the electrically conductive brush 11 onto the photosensitive drum 1 due to a cleaning sequence for the electrically conductive brush 11 is not limited to the transferring belt cleaner 75. Means for recovering toner directly from the photosensitive drum 1 may be included.

3) The contact charging member may be a fur brush charging member, a charging roller using electrically conductive rubber or sponge, or the like. The contact charging member may also be adapted not to rotate.

4) To realize charge injection charging and prevent ozone production, the image bearing body desirably has a low-resistance layer with a surface resistance of $10^9$ to $10^{14}$ Ω·cm. The body may be organic photosensitive bodies other than mentioned above. That is, contact charging is not limited to the charge injection charging methods used for the embodiments. A contact charging system governed by charging may be used.

5) The embodiments only uses the developing apparatus which uses a two-component developing method, but other developing methods are effective. One-component development and two-component development methods which preferably develop a latent image with a developer in contact with a photosensitive body enhance the simultaneous recovery effect of the developer.

If developer containing polymerized toner particles is used, other developing methods, such as one-component and two-component non-contact methods, as well as one-component and two-component contact methods exhibit a satisfactory recovery effect.

6) Sinusoidal, rectangular, and triangular alternating voltage (AC voltage) wave forms can be used as appropriate. Rectangular waveforms formed by periodically turning on and off a DC power supply may be used. As described above, biases whose voltage changes periodically can be used for an AC voltage waveform.

7) Image exposing means for forming an electrostatic latent image is not limited to laser scanning exposing means for forming a digital latent image as in the embodiments. The present invention permits ordinary analog image exposing means; other light-emitting elements, such as an LED; or means which can form an electrostatic latent image according to image information, including those using a combination of a light-emitting element, such as a fluorescent lamp, and liquid crystal shutter or the like.

The image bearing body may be an electrostatic record dielectric or the like. After its surface is uniformly subjected to primary charging to provide predetermined polarity and potential, a dielectric is discharged using discharging means, such as an arrester head or an electron gun, to form a desired electrostatic latent image.

8) The transferring apparatus may be of a transferring roller type. a recording medium onto which a toner image is transferred from an image bearing body may be an intermediate transferring body, such as a transferring drum.

The embodiments of the present invention have been described above. The present invention is not limited to these embodiments, but various modifications can be made without departing from the scope of the present invention.

What is claimed is:

1. An image forming apparatus comprising:

an image bearing body;

charging means for charging said image bearing body in a predetermined polarity;

image forming means for forming an electrostatic image on the image bearing body charged by said charging means;

developing means for developing the electrostatic image on said charging means using toner charged in a same polarity as the predetermined polarity and recovering a residual toner from said image bearing body;

transferring means for transferring the toner image on said image bearing body onto a transferring sheet;

auxiliary means which comes in contact with said image bearing body after transfer, so that a voltage opposite in polarity to the predetermined polarity given by said charging means is applied to the auxiliary means when an image is formed; and cleaning means for cleaning said auxiliary means by producing such an electric field that toner charged in the same polarity as the predetermined polarity goes from said auxiliary means to said image bearing body when an image is not formed.

2. The image forming apparatus according to claim 1, wherein said cleaning means charges said image bearing body to produce a cleaning electric field when no transferring sheet is at a transferring location of said transferring means.

3. The image forming apparatus according to claim 1, wherein said cleaning means activates said transfer means and forms the electric field by stopping applying a voltage to said auxiliary means.

4. The image forming apparatus according to claim 1, wherein said auxiliary means erases image traces on said image bearing body.

5. The image forming apparatus according to claim 1, further comprising determining means for determining a time at which said cleaning means performs cleaning.

6. The image forming apparatus according to claim 5, wherein said determining means determines a cleaning time according to an image information signal.

7. The image forming apparatus according to claim 1, wherein said charging means temporarily recovers residual toner from said image bearing body.

* * * * *

UNITED STATES PATENT AND TRADEMARK OFFICE

CERTIFICATE OF CORRECTION

PATENT NO. : 6,801,735 B2
DATED : October 5, 2004
INVENTOR(S) : Yoshiyuki Komiya et al.

It is certified that error appears in the above-identified patent and that said Letters Patent is hereby corrected as shown below:

Title page,
Item [56], References Cited, FOREIGN PATENT DOCUMENTS,
"7-72774 A 3/1996" should read -- 7-72774 A 3/1995 --.
Item [57], ABSTRACT, "let image traces leave" should read -- leave image traces --.

Column 1,
Line 22, "large" should read -- image --; and
Line 32, "is disposed, a charging location a being" should read -- being disposed, a charging location a is --.

Column 3,
Line 20, "105," should read -- 105, which is an --; and
Line 21, "which" should read -- and which --.

Column 4,
Line 14, "let image traces leave." should read -- leave image traces. --.

Column 5,
Line 6, "denotes" should read -- denote --.

Column 8,
Line 42, "if" should read -- 1f --; and
Line 62, "mixture is developed come" should read -- mixture developed comes --.

Column 9,
Line 27, "has" should read -- have --; and
Line 39, "indicated" should read -- as indicated --.

Column 10,
Line 45, "not" should read -- is not --; and
Line 49, "sulfon" should read -- sulfone --.

Column 11,
Line 9, "the" should read -- by the --;
Line 11, "in the" should read -- in by the --;
Line 20, "in the" should read -- in by the --;
Line 46, "easy" should read -- easily --; and
Line 47, "to take in the" should read -- taken in by the --.

UNITED STATES PATENT AND TRADEMARK OFFICE

CERTIFICATE OF CORRECTION

PATENT NO. : 6,801,735 B2
DATED : October 5, 2004
INVENTOR(S) : Yoshiyuki Komiya et al.

It is certified that error appears in the above-identified patent and that said Letters Patent is hereby corrected as shown below:

Column 13,
Line 16, "with" should read -- to --.

Column 14,
Line 20, "image" should read -- image to be prevented from forming --; and
Line 56, "uses" should read -- use --.

Column 15,
Line 23, "a" (first occurrence) should read -- A --.

Signed and Sealed this

Twenty-first Day of June, 2005

JON W. DUDAS
*Director of the United States Patent and Trademark Office*